US005238793A

United States Patent [19]

Hoyen, Jr.

[11] Patent Number: 5,238,793

[45] Date of Patent: Aug. 24, 1993

[54] PHOTOGRAPHIC PROCESS

[75] Inventor: Harry A. Hoyen, Jr., Webster, N.Y.

[73] Assignee: Eastman Kodak Company, Rochester, N.Y.

[21] Appl. No.: 351,322

[22] Filed: May 8, 1989

Related U.S. Application Data

[63] Continuation-in-part of Ser. No. 202,632, Jun. 6, 1988, abandoned.

[51] Int. Cl.[5] ..... G03C 5/00

[52] U.S. Cl. ..... 430/446; 430/372; 430/399; 430/400; 430/418; 430/419; 430/427; 430/428; 430/432; 430/463; 430/581; 430/563; 430/585

[58] Field of Search ..... 430/372, 418, 427, 428, 430/432, 463, 446, 581, 583, 585, 419, 453, 459, 400, 399

[56] References Cited

U.S. PATENT DOCUMENTS

| | | | |
|---|---|---|---|
| 2,657,140 | 10/1953 | Kessels | 430/149 |
| 2,933,390 | 4/1960 | McFall et al. | 430/550 |
| 2,945,762 | 7/1960 | Carroll et al. | 430/550 |
| 2,950,196 | 8/1960 | Carroll et al. | 430/550 |
| 3,615,641 | 10/1971 | Shiba et al. | 430/576 |
| 4,232,112 | 11/1980 | Kuse | 430/393 |
| 4,232,112 | 11/1980 | Kuse | 430/393 |
| 4,444,871 | 4/1984 | Miyasaka et al. | 430/378 |
| 4,587,195 | 5/1986 | Ishikawa et al. | 430/372 |
| 4,603,104 | 7/1986 | Philip, Jr. | 430/572 |
| 4,774,169 | 9/1988 | Kuse et al. | 430/467 |

FOREIGN PATENT DOCUMENTS 3627122 2/1987 Fed. Rep. of Germany .

*Primary Examiner*—Charles L. Bowers, Jr.
*Assistant Examiner*—Thorl Chea
*Attorney, Agent, or Firm*—Gordon M. Stewart

[57] ABSTRACT

A method of processing a photographic element having a layer comprising a silver halide emulsion sensitized with a cyanine dye where the dye is present in the processing solution at a concentration sufficient to cause formation of solid dye particles. The method comprises contacting the element with at least one processing solution in the presence of an effective amount of a dye solubilizing compound of the formula:

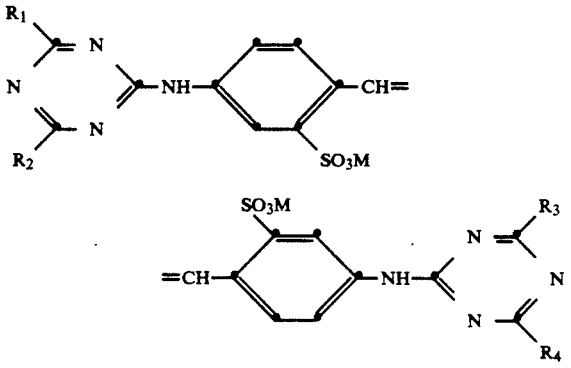

wherein $R_1$, $R_2$, $R_3$, and $R_4$ are each independently selected from the group consisting of

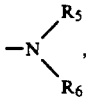

halogen, hydrogen, hydroxy, substituted or unsubstituted alkyl, substituted or unsubstituted aryl, substituted or unsubstituted alkoxy, and sulfo, $R_5$ and $R_6$ are each independently selected from the group consisting of hydrogen, substituted or unsubstituted alkyl, and substituted or unsubstituted aryl, with the proviso that the dye solubilizing compound comprises at least four solubilizing groups as substituents on $R_5$'s or $R_6$'s that are alkyl or aryl wherein at least one of the solubilizing groups is anionic sulfo.

11 Claims, No Drawings

PHOTOGRAPHIC PROCESS

This is a continuation-in-part of U.S. application Ser. No. 202,632, filed Jun. 6, 1988, now abandoned.

FIELD OF THE INVENTION

This invention relates to photography, especially photographic processes for elements having silver halide sensitized with a cyanine dye.

BACKGROUND OF THE INVENTION

Silver halide elements are usually subjected to some type of photographic processing after exposure in order to form images suitable for viewing. The processing generally involves contacting the element with a developer solution to cause formation of a silver image corresponding to a latent image formed on the silver halide during exposure, and then with a fixing solution to solubilize and remove silver halide that was not converted to silver during development. Any of a number of other known processing solutions may also be used, such as stop baths to halt image development, bleach solutions to remove already formed silver from the element, and a number of other known solutions (e.g., stabilizer baths, hardener solutions, wash baths, and the like).

The silver halide that is used in photographic elements is usually inherently sensitive only to blue light. It is therefore often desirable, in order to provide sensitivity to light of other regions of the spectrum or to enhance the sensitivity to blue light, to spectrally sensitize the silver halide by adsorbing a sensitizing dye to the silver halide, thus imparting to the silver halide sensitivity to the wavelength of light absorbed by the dye.

When photographic elements having spectrally sensitized silver halide are processed, the sensitizing dye can come out of the element and enter one or more of the processing solutions. Indeed, it is usually desirable to remove (usually in the fixing bath) the sensitizing dye from the element during processing so as to minimize adverse effects on image quality that can occur as a result of sensitizing dye remaining in the element after processing.

It has now been found, however, that certain problems are encountered in situations where a large amount of sensitizing dye is present in a photographic element (on the order of 0.3 mg/ft$^2$), or when the rate of replenishment of the processing solution(s) is low, or both. Large amounts of sensitizing dye may be present because of the particular sensitization of silver halide that is desired, or simply because an element contains a large amount of silver halide. In such situations, the sensitizing dye, instead of coming out of the element and dissolving in a processing solution, is removed from the element, but is not fully solubilized in the processing solution and forms solid particles. These particles can have a number of adverse effects. They can adhere to the surface of the element, forming visible specks or blotches on the image. They can also adhere to processing equipment, impeding flow or mixing of processing solutions, and necessitating costly and time-consuming cleaning procedures.

SUMMARY OF THE INVENTION

It has now been found that the formation of solid dye particles in processing solutions can be reduced by a process where the the element is contacted with a processing solution that is susceptible to dye particle formation in the presence of an effective amount of a dye solubilizing compound of the formula:

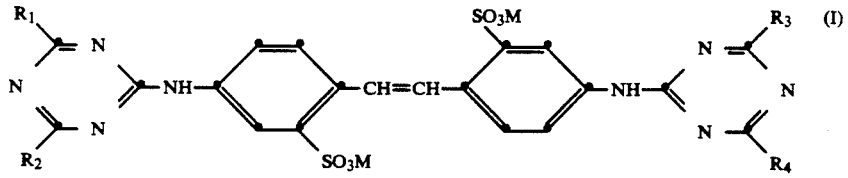

(I)

wherein $R_1$, $R_2$, $R_3$, and $R_4$ are each independently selected from the group consisting of

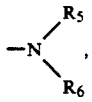

halogen, hydrogen, hydroxy, substituted or unsubstituted alkyl, substituted or unsubstituted aryl, substituted or unsubstituted alkoxy, and sulfo, $R_5$ and $R_6$ are each independently selected from the group consisting of hydrogen, substituted or unsubstituted alkyl, and substituted or unsubstituted aryl, with the proviso that the dye solubilizing compound comprises at least four solubilizing groups as substituents on $R_5$'s or $R_6$'s that are alkyl or aryl wherein at least one of the solubilizing groups is anionic sulfo.

DESCRIPTION OF THE PREFERRED EMBODIMENTS

According to formula (I), $R_1$, $R_2$, $R_3$, and $R_4$ are each independently selected from the group consisting of

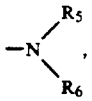

halogen (e.g., fluoro, chloro, bromo, iodo), substituted or unsubstituted alkoxy of from 1 to 6 carbon atoms (e.g., methoxy, ethoxy, propoxy). $R_5$ and $R_6$ are each independently hydrogen, substituted or unsubstituted alkyl of from 1 to 7 carbon atoms (e.g., methyl, ethyl, propyl, isopropyl, t-butyl, n-hexyl, etc.), or substituted or unsubstituted aryl (e.g., phenyl, naphthyl, and the like). Useful substituents for the above R groups can include any of a number substituents commonly utilized for such groups that do not adversely affect the properties of the compound to a significant degree. Examples of such substituents include halogen, alkyl, aryl, and alkoxy as described above, as well as other known substituents, such as allyl, thioethers, etc . . . .

For a compound of formula (I) to be useful according to the invention, it must have at least four solubilizing groups as substituents on $R_5$'s or $R_6$'s and at least one of those solubilizing groups must be anionic sulfo. These solubilizing groups are groups that tend to increase the solubility of organic compounds in water. Such solubilizing groups are well-known in the art and include, for example, sulfo, carboxy, and hydroxy. By anionic sulfo is meant an ionized $-SO_3^{\theta}$ group associated with a counterion, as opposed to an acidic $-SO_3H$ group. It should be noted that the invention requires that since the invention requires contact of the photographic element in the presence of a compound of formula (I), the sulfo group may be in acid form prior to such contact. For example, if the dye solubilizing compound of formula (I) is being used in conjunction with a developer solution with a high pH (usually 9 or above), then the solubilizing group may be an acidic $-SO_3H$ group until contact with the developing solution, at which time the high pH would ionize the sulfo group.

Clearly, by inference from the requirement that the compound of formula (I) comprise four solubilizing groups as substituents on $R_5$'s or $R_6$'s, at least three of $R_1$, $R_2$, $R_3$, or $R_4$ must be

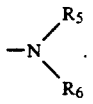

The solubilizing groups include any group whose presence as a substituent on the compound of formula (I) will tend to render it more soluble in aqueous solutions than without it.

Examples of useful compounds according to formula (I) are presented below in Table I.

TABLE I

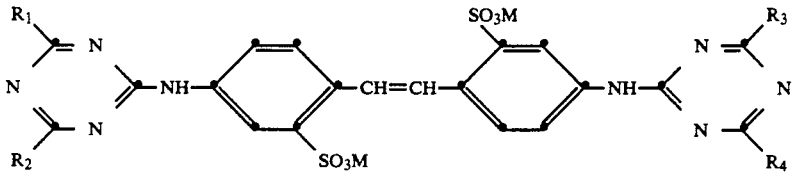

| Compound | $R_1$ | $R_2$ | $R_3$ | $R_4$ |
|---|---|---|---|---|
| 1 | $-N(CH_2CH(CH_3)OH)_2$ | 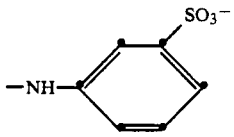 | $R_2$ | $R_1$ |
| 2 | $-N(CH_2CH_2OH)_2$ | 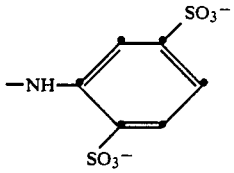 | $R_2$ | $R_1$ |
| 3 | $-N(CH_2CH_2OH)_2$ | 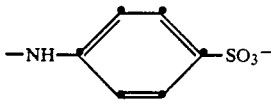 | $R_2$ | $R_1$ |
| 4 | $-N(CH_2CH_2OH)_2$ | 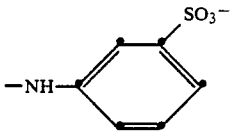 | $R_2$ | $R_1$ |
| 5 | $-N(CH_2CH_3)_2$ | 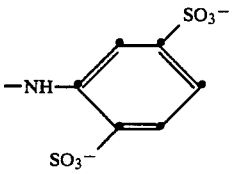 | $R_2$ | $R_1$ |

The compounds of formula (I) can be made by methods well-known in the art. Such methods are described in, for example, U.S. Pat. Nos. 3,617,295, 3,615,641, 2,937,089, and 3,615,632.

The dye solubilizing compound of formula (I) can be incorporated in any processing solution where the sensitizing dye would be present in the solution at a concentration sufficient to cause formation of solid dye particles in the absence of the dye solubilizing compound. Alternatively, the dye solubilizing compound can be incorporated in the photographic element so that the dye solubilizing compound is present when the element is contacted with the solution that is susceptible to dye particle formation.

The compound of formula (I) can be used in conjunction with any combination of photographic element and process that is susceptible to formation of solid particles of cyanine sensitizing dye in any of the processing solutions.

The cyanine sensitizing dye can be any of a number of such dyes, which are well-known in the art. The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, thiazolium, selenazolinium, imidazolium, benzoxazolinium, benzothiazolium, benzoselenazolium, benzimidazolium, naphthoxazolium, naphthothiazolium, naphthoselenazolium, thiazolinium dihydronaphthothiazolium, pyrylium, and imidazopyrazinium quaternary salts. Further description and examples of such dyes can be found in James, *The Theory of the Photographic Process 4th*, 1977 and in *Research Disclosure*, December, 1978, item 17643 (hereinafter referred to as "*Research Disclosure I*"), the disclosures of which are incorporated herein by reference in their entirety.

Useful cyanine dyes include those according to the formula:

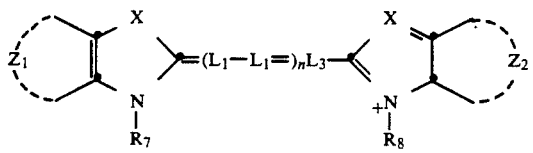

In this formula, $Z_1$ and $Z_2$ represent the atoms necessary to complete a substituted or unsubstituted aromatic ring structure. $R_7$ and $R_8$ are each independently substituted or unsubstituted alkyl of 1 to 12 carbon atoms (e.g., methyl, ethyl, propyl, butyl). $R_7$ and $R_8$ may be substituted with substituents as is known in the art, such as halogen, alkoxy, aryl, aryloxy, sulfo, carboxyl, and the like). $L_1$, $L_2$, and $L_3$ are each independently substituted (with substituents known in the art, e.g., alkyl) or unsubstituted methine linkages. X is O, S, Se, -C-, or N- and n is 0, 1, or 2.

Photographic elements useful in the practice of the invention generally comprise a support having thereon at least one silver halide emulsion layer. The silver halide emulsion can comprise any type of silver halide that is useful in photographic emulsions. This includes silver bromide, silver iodide, silver chlorobromide, silver bromoiodide, silver chlorobromoiodide, or mixtures thereof. The silver halide can be in the form of grains bounded by 100, 111, or 110 crystal planes, as described in Research Disclosure I, or in the form of tabular grains, as described in Research Disclosure, January, 1983, item 22534, the disclosure of which is incorporated herein by reference in its entirety. The silver halide can be present in any amount known in the art to be useful in photographic emulsions. The silver halide is generally present in the emulsion in an amount such that when it is coated as a layer in a photographic element, the coverage of silver will be from 100 to 300 mg/ft$^2$.

The amount of sensitizing dye in the emulsion can be any amount that is known in the art to be useful for spectral sensitization of silver halide, subject to the requirement that it be sufficient to cause formation of solid dye particles in a solution for processing the element. The quantity of dye employed will vary with the specific dye or dye combination chosen as well as the size and aspect ration of the grains. It is known in the photographic art that optimum spectral sensitization is obtained with organic dyes at about 25 to 100 percent or more of monolayer coverage of total available surface area of surface sensitive silver halide grains, as disclosed for example, in West et al, "The Adsorption of Sensitizing Dyes in Photographic Emulsions," *Journal of Phys. Chem.*, Vol. 56, p. 1065, 1952 and Gilman et al U.S. Pat. No. 3,979,213. Optimum dye concentration levels can be chosen by procedures taught by Mees, *Theory of the Photographic Process*, Macmillan (1942), pp. 1067–69, the disclosure of which is incorporated herein by reference. Preferred dye amounts in photographic elements useful according to the present invention range from 100 to 1000 mg/ft$^2$.

One or more spectral sensitizing dyes may be used to achieve a desired spectral sensitization of the silver halide as well as to achieve results such as supersensitization, as discussed by Gilman in *Photographic Science and Engineering*, Vol. 18, 1974, pp. 418–30. Examples of supersensitizing dye combinations include those disclosed in McFall et al U.S. Pat. No. 2,933,390, Jones et al U.S. Pat. No. 2,937,089, Motter U.S. Pat. No. 3,506,443, and Schwan et al U.S. Pat. No. 3,672,898, the disclosures of which are incorporated herein by reference.

The emulsion preferably includes a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid-treated gelatin such as pigskin gelatin), gelatin derivatives (e.g., acetylated gelatin, phthalated gelatin, and the like), polysaccharides (e.g., dextran, gum arabic, casein, pectin, and the like), and others, as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount known to be useful in photographic emulsions.

The silver halide emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure*, June, 1975, item 13452 and U.S. Pat. No. 3,772,031.

Other addenda include brighteners, antifoggants, stabilizers, filter dyes, light absorbing or reflecting pigments, vehicle hardeners such as gelatin hardeners, coating aids, dye-forming couplers, and development modifiers such as development inhibitor releasing couplers and bleach accelerators. These addenda and methods of inclusion in the emulsion are well-known in the art and are disclosed in *Research Disclosure I* and the references cited therein.

The emulsion and other layers of photographic elements can be coated onto a support using techniques well-known in the art. These techniques include immersion or dip coating, roller coating, reverse roll coating, air knife coating, doctor blade coating, stretch-flow coating, and curtain coating.

The silver halide emulsion layer of the photographic element can be coated simultaneously or sequentially with other emulsion layers, subbing layers, filter dye layers, or interlayers or overcoat layers containing various addenda known to be included in photographic elements, such as antifoggants, oxidized developer scavengers, DIR couplers, antistatic agents, optical brighteners, light-absorbing or light-scattering pigments, and the like. The coated layers of the photographic element may be chill-set or dried, or both. Drying may be accelerated by known techniques such as conduction, convection, radiation heating, or a combination thereof.

The photographic element useful in the practice of the invention can be black and white or color. Certain black and white elements requiring moderately high density in imaged areas, minimum density in non-imaged areas, and sufficient contrast to yield high quality definition images (e.g., microfilm or microfiche elements), contain sufficient amounts of silver halide (i.e., 100 to 200 mg/ft$^2$) so that when they are sensitized with a cyanine dye, the amount of cyanine dye is sufficient to cause dye particle formation in processing solutions. A color photographic element generally contains three silver halide emulsion layers: a blue-sensitive layer having a yellow color coupler associated therewith, a green-sensitive layer having a magenta color coupler associated therewith, and a red-sensitive layer having a cyan color coupler associated therewith.

The compound of formula (I) can be used in conjunction with essentially any known process, the exact type of which is not critical. Such processes generally include contacting the element with an aqueous alkaline solution of a developing agent, and then contacting the element with a solution of fixing agent or with bleaching and fixing agent(s). Examples of processing formulations and techniques are described in L. Mason, *Photographic Processing Chemistry*, Focal Press, London, 1966; *Processing Chemicals and Formulas*, Publication J-1, Eastman Kodak Company, 1985; *Photo-Lab Index*, Morgan & Morgan, Inc., Dobbs Ferry, New York, 1977; and *Neblette's Handbook of Photography and Reprography Materials, Processes and Systems*, VanNostrand Reinhold Co., 7th Ed., 1977, the disclosures of which are incorporated herein by reference.

The compound of formula (I) can be incorporated in the element or in any processing solution in which solid dye particle formation is a problem. When the compound is to be included in a processing solution, it is preferably incorporated in a developing solution or a fixing solution.

Developing solutions generally have a pH of 9 or more, although that is not a requirement of the invention. The use of the compound of formula (I) in an alkaline developing solution, as indicated above, does allow for ionization of any acidic sulfo solubilizing groups on the compound. The developing agent can be any of the known developing agents, as described in James, *The Theory of the Photographic Process*, 4th, Macmillan, 1977 [hereinafter "James"], Chapter 11, the disclosure of which is incorporated herein by reference. Useful developing agents include hydroquinones, catechols, aminophenols, pyrazolidones, phenylenediamines, tetrahydroquinolines, bis(pyridone)amines, cycloalkenones, pyramidines, reductones, and coumarins.

Fixing agents are also known in the art, as described in James, Chapter 15, the disclosure of which is incorporated by reference. Useful fixing agents include thiosulfates, thiocyanates, cyanides, sulfite, ammonia, thiourea, thioacids, thiosugars, concentrated alkali halides, and organic solvents such as acetone. Thiosulfates, such as sodium thiosulfate or ammonium thiosulfate are among the most commonly-used fixing agents.

Other solutions commonly used in the processing of photographic elements, which may also include a compound of formula (I), include wash baths consisting primarily of water and optionally pH buffers or other stabilizers, bleach or bleach/fix solutions, color developer solutions (which may or may not contain photographic couplers, stop baths for arresting photographic development, gelatin hardening solutions, and other known photographic processing solutions. All these solutions and processing steps are well-known in the art.

The invention is further illustrated by the following examples.

EXAMPLE 1

A photographic element was prepared, having an emulsion layer containing gelatin at a coverage of 145 mg/ft$^2$ and silver bromide at a coverage of 150 mg/ft$^2$ sensitized with a dye of the formula:

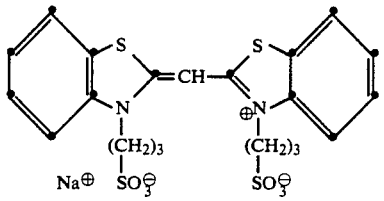

at a coverage of 0.5 mg/ft$^2$. Samples of the element were processed in a semicontinuous batch process in which the element moves successively from one tank to the next of well-mixed non-replenished processing solutions. The tanks were set up as described in Table II below:

TABLE II

| Tank | Components (level-g/l) | | Volume (gal) | Processing Time |
|---|---|---|---|---|
| 1 | Developer | | | |
| | hydroquinone | (45) | 0.5 | 15 sec |
| | momomethyl-p-amino-phenol-sulfonate | (12.5) | | |
| | $NaSO_3$ | (140) | | |
| | NaBr | (2.5) | | |
| | pH = 10.9 | | | |
| 2 | same as 1 | | 0.5 | 15 sec |
| 3 | Fixer | | | |
| | ammonium thiosulfate | (140) | 0.5 | 15 sec |
| | $NaSO_3$ | (25) | | |
| | pH = 5.0 | | | |
| 4 | Wash | | 0.5 | 15 sec |
| 5 | Wash | | 0.5 | 15 sec |

After 50 ft$^2$ had been processed, a number of visible dye particles had formed in the solutions of Tanks 2 and 3.

The semicontinuous batch was repeated except that tanks 1 and 2 also contained 0.5 g/l of compound 5 from Table I. After 200 ft$^2$ of film had been processed, no dye particles were observed in any of the tanks.

The semicontinuous batch was again repeated except that tank 3 instead of tanks 1 and 2 contained 0.5 g/l of compound 5 from Table I. Again, after 100 ft$^2$ of film had been processed, no dye particles were observed in any of the tanks.

EXAMPLE 2

The effect of dye solubilizing compounds according to formula (I) from Table I on varying dyes in varying processing solutions was evaluated according to the following procedure.

To 0.1 l of room temperature developer (D) or fixer (F) solutions of the formulations in Example 1, containing or not containing (as indicated in Table IV) 50 mg of Table I dye solubilizing compound, 5 mg of dyes D-1, D-2, or D-3 were added. Comparison compounds as shown in Table III were also tried as dye solubilizing compounds. The formation of dye particles was then determined by visual observation. The results are set forth in Table IV.

TABLE III

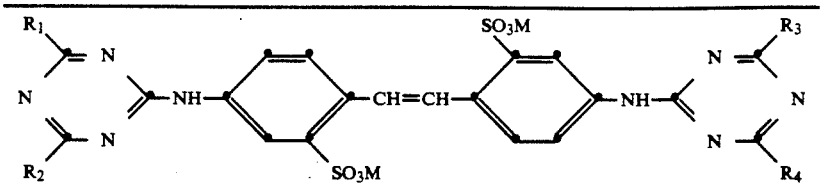

| Compound | $R_1$ | $R_2$ | $R_3$ | $R_4$ |
|---|---|---|---|---|
| C-6 | $-NH(CH_2)_2SO_3^-$ | $-OCH_3$ | $-N(C_2H_4OH)_2$ | $R_2$ |
| C-7 | Cl | $CH_3N(CH_2)_2OH$ | $R_2$ | $R_1$ |
| C-8 | $-N(CH_2CH_2OH)_2$ | 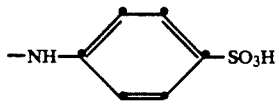 | | $R_1$ |
| C-9 | $-N(CH_2CH_2OH)_2$ | 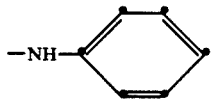 | $R_2$ | $R_1$ |
| C-10 | $-N(CH_2CH_2OH)_2$ | 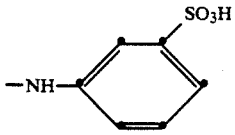 | $R_2$ | $R_1$ |
| C-11 | $-N(CH_2CH_2OH)_2$ | $-N(CH_2CH_2OH)_2$ | $R_2$ | $R_1$ |
| C-12 | $-NHCH_3$ | 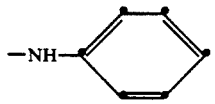 | $R_2$ | $R_1$ |
| C-13 | $-OH$ | 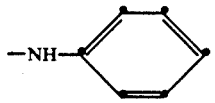 | $R_2$ | $R_1$ |
| C-14 | $-SO_3^-$ | $-SO_3^-$ | $R_2$ | $R_1$ |

TABLE IV

| Dye Solubilizing Compound | Solution | Dye | Solubility |
|---|---|---|---|
| none (control) | F | D-1 | I* |
| none (control) | D | D-1 | I* |
| none (control) | F | D-2 | I* |
| none (control) | D | D-2 | I* |
| none (control) | F | D-3 | I* |
| none (control) | D | D-3 | I* |
| 1 | F | D-1 | S |
| 1 | F | D-2 | S |
| 1 | F | D-3 | S |
| 1 | D | D-1 | S |
| 2 | F | D-1 | S |
| 2 | F | D-2 | S |
| 2 | F | D-3 | S |
| 2 | D | D-1 | S |
| 3 | D | D-1 | S |
| 4 | D | D-1 | S |
| 5 | F | D-1 | S |
| 5 | F | D-2 | S |
| 5 | F | D-3 | S |
| 5 | D | D-1 | S |
| C-6 | F | D-1 | I |

TABLE IV-continued

| | | | |
|---|---|---|---|
| C-6 | F | D-2 | I |
| C-6 | F | D-3 | I |
| C-6 | D | D-1 | I |
| C-7 | F | D-1 | I |
| C-7 | D | D-1 | I |
| C-8 | F | D-1 | I** |
| C-9 | F | D-1 | I |
| C-9 | D | D-1 | I |
| C-10 | F | D-1 | I** |
| C-11 | F | D-1 | I |
| C-11 | D | D-1 | I |
| C-12 | F | D-1 | I |
| C-12 | D | D-1 | I |
| C-13 | F | D-1 | I |
| C-13 | F | D-2 | I |
| C-13 | F | D-3 | I |
| C-14 | F | D-1 | I |

S = Soluble (no particles observed)
I = Insoluble (many particles observed)
*Dye particle formation was also observed at lower dye concentrations of around 0.01 g/l.
**After initially dissolving, solid particles re-formed.

D-1

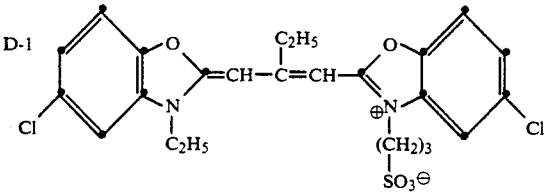

D-2

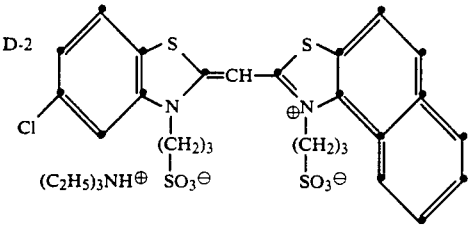

D-2

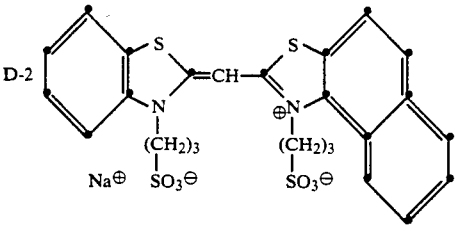

The results presented in Table IV indicate that compounds according to formula (I) are significantly better dye solubilizing compounds than the comparison compounds.

The invention has been described in detail with particular reference to preferred embodiments thereof, but it will be understood that variations and modifications can be effected within the spirit and scope of the invention.

What is claimed is:

1. A method of processing a black and white photographic element having a layer comprising a silver halide emulsion sensitized with a cyanine dye, comprising contacting the element with at least one processing solution in the presence of an effective amount of a dye solubilizing compound of the formula:

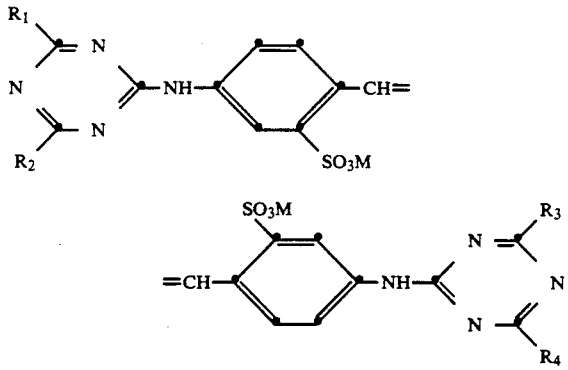

wherein $R_1$, $R_2$, $R_3$, and $R_4$ are each independently selected from the group consisting of

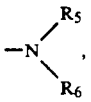

halogen, hydrogen, hydroxy, substituted or unsubstituted alkyl, substituted or unsubstituted aryl, substituted or unsubstituted alkoxy, and sulfo, $R_5$ and $R_6$ are each independently selected from the group consisting of hydrogen, substituted or unsubstituted alkyl, and substituted or unsubstituted aryl, with the proviso that the dye solubilizing compound comprises at least four solubilizing groups as substituents on $R_5$'s or $R_6$'s that are alkyl or aryl wherein at least one of the solubilizing groups is anionic sulfo, and wherein the cyanine dye is present in the processing solution at a concentration sufficient to cause formation of solid dye particles in the absence of the dye solubilizing compound.

2. A method according to claim 1 wherein the element is exposed to light and the processing solution is a photographic developing solution.

3. A method according to claim 1 wherein the element is exposed to light and the processing solution is a photographic fixing solution.

4. A method according to claim 1 wherein the dye is of the formula:

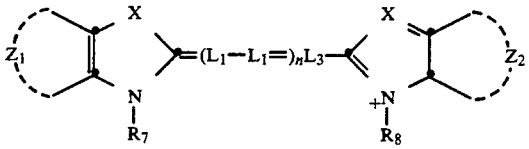

wherein $Z_1$ and $Z_2$ represent the atoms necessary to complete a substituted or unsubstituted aromatic ring structure, $R_7$ and $R_8$ are each independently substituted or unsubstituted alkyl, $L_1$, $L_2$, and $L_3$ are each independently substituted or unsubstituted methine linkages, X is O, S, Se, —C—, or N—, and n is 0, 1, or 2.

5. A method according to claim 4 wherein the dye is selected from the group consisting of:

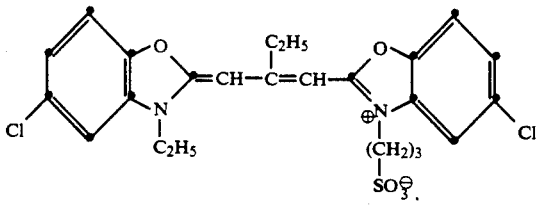

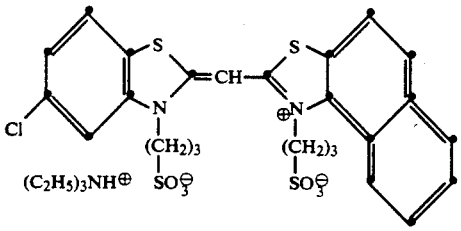

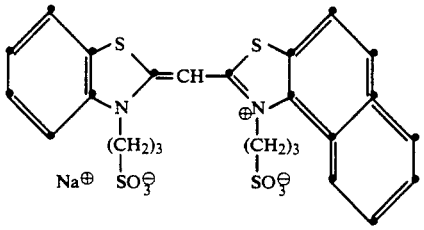

6. A method according to claim 1 wherein the processing solution comprises from 0.01 to 1.0 g/l of the sensitizing dye.

7. A method according to claim 1 wherein the processing solution comprises from 0.1 to 10 g/l of the dye solubilizing compound.

8. A method according to claim 1 wherein $R_1$, $R_2$, $R_3$, and $R_4$ are each independently

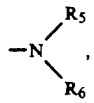

wherein each $R_5$ and $R_6$ is independently substituted or unsubstituted alkyl or substituted or unsubstituted aryl, with the proviso that $R_1$, $R_2$, $R_3$, and $R_4$ together comprise at least 5 solubilizing groups, at least one of which is anionic sulfo.

9. A method according to claim 1 wherein the solubilizing groups are selected from the group consisting of sulfo, hydroxy, or carboxy.

10. A method according to claim 1 wherein the cyanine dye is present in the processing solution at a concentration sufficient to cause formation, in the absence of the dye solubilizing compound, of solid dye particles having a mean diameter of at least 0.3 μm.

11. A method according to claim 1 wherein $R_1$ and $R_3$ are each independently

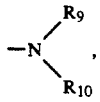

where $R_9$ and $R_{10}$ are each independently hydroxy-substituted alkyl of from 1 to 6 carbon atoms, and $R_2$ and $R_4$ are each independently

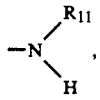

where $R_{11}$ is sulfo-substituted aryl of from 6 to 10 carbon atoms.

* * * * *